United States Patent [19]

Gary

[11] 4,442,640

[45] Apr. 17, 1984

[54] METHOD OF CONVERTING A ROOF FRAME AND FRAME ELEMENTS FOR PERFORMING THIS METHOD

[76] Inventor: Jean-Pierre Gary, Z. I. du Fort, rue de haut de la Cruppe, 59650 Villeneuve d'Ascq, France

[21] Appl. No.: 478,844

[22] Filed: Mar. 25, 1983

[51] Int. Cl.[3] ..... E04B 7/04

[52] U.S. Cl. ..... 52/90; 52/741

[58] Field of Search ..... 52/90, 92, 223 R, 741, 52/747

[56] References Cited

U.S. PATENT DOCUMENTS

| | | | |
|---|---|---|---|
| 3,387,413 | 6/1968 | Huey | 52/90 X |
| 4,078,353 | 3/1978 | Thesingh | 52/223 R |
| 4,275,537 | 6/1981 | Pinson | 52/223 R |
| 4,304,074 | 12/1981 | Donahue | 52/92 |
| 4,373,837 | 2/1983 | Lin et al. | 52/223 R X |

FOREIGN PATENT DOCUMENTS

| | | | |
|---|---|---|---|
| 1684426 | 10/1969 | Fed. Rep. of Germany . | |
| 2626601 | 3/1977 | Fed. Rep. of Germany . | |
| 1203868 | 8/1959 | France | 52/90 |
| 2411283 | 7/1979 | France . | |
| 133452 | 1/1979 | German Democratic Rep. | 52/90 |

*Primary Examiner*—J. Karl Bell

*Attorney, Agent, or Firm*—Kerkam, Stowell, Kondracki & Clarke

[57] ABSTRACT

A vertical channel is secured between each principal rafter and the tie-beam of each of a plurality of roof trusses. At the same time there are engaged in the channels, beams divided into a plurality of sections and bearing on the gable walls. The sections of each beam are connected by connection means, under each of which there is fixed a king post. Subsequently the base of each of the king posts is engaged by two ties whose other ends are connected to the ends of the beam sections located either side of the king post in question. The method may be used in the industry of converting buildings, in particular houses, having a roof with two, three, or four slopes.

9 Claims, 4 Drawing Figures

Fig. 1
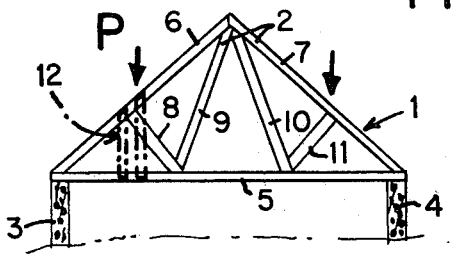
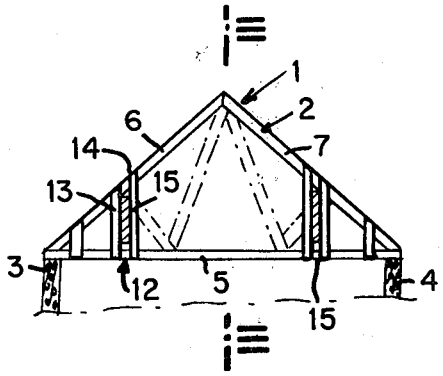
Fig. 2
Fig. 3
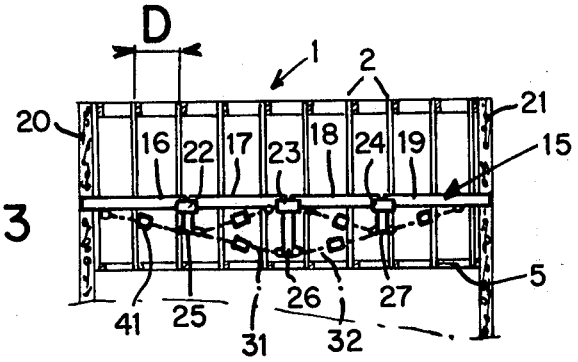
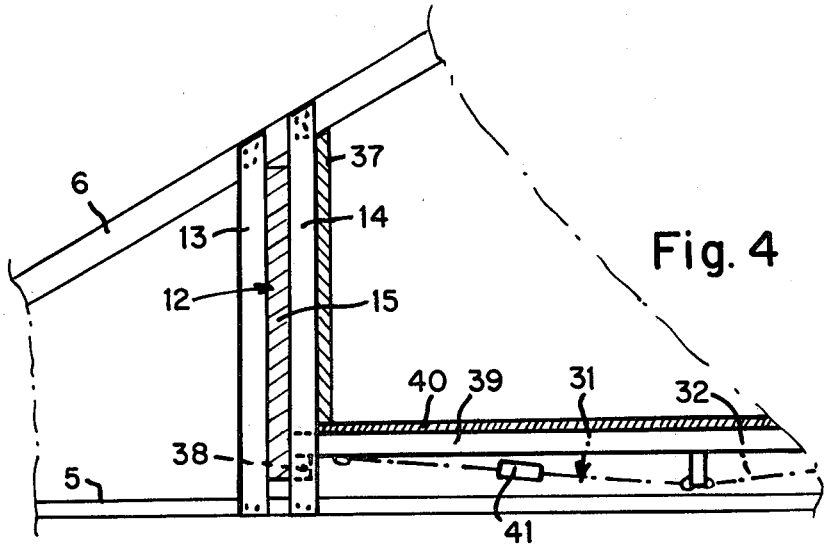
Fig. 4

METHOD OF CONVERTING A ROOF FRAME AND FRAME ELEMENTS FOR PERFORMING THIS METHOD

TECHNICAL FIELD

The invention relates to a method of converting a frame and to frame elements for performing this method. It applies to the conversion of the frames of roofs which cannot be fitted out, in order to render them such that they may be fitted out.

BACKGROUND ART

Commonly, roof frames are formed by a number of trusses placed at a slight distance from one another and extending from one facade wall to another, on which they bear. The roofing bears on the trusses, which are held in place by cross-pieces.

The trusses in principle comprise a horizontal beam called a tie-beam, which thus connects the facade walls at the front and the rear, and two inclined pieces of wood called the principal rafters, each one passing from one end opposite the entrance and joining each other at the apex of the roof. However, these trusses are light and have to be reinforced.

Their reinforcements consist of a triangulation formed of elements, some of which, operating under tension from the apex of the truss, support the tie-beam, while the others, operating under compression by bearing at the base of the former elements, support—generally at their center—the principal rafters, which otherwise would be too flexible to support the roofing. This triangulation, which is repeated at each truss and constitutes an impediment to the fitting out of the roof, evidently cannot be removed without endangering the principal rafters, the cladding, and the ceiling, without other precautions being taken.

In new constructions (French Pat. No. A-2411283), before cladding, it is, of course, known and simple to provide beams which extend from one gable wall to another and on which the principal rafters of the trusses bear, which may then be devoid of support triangulation, at least in the zone liable to form the habitable part of the roof.

When existing constructions are converted it is evidently possible to expose the frame so as to enable the passage and positioning of beams, as well as to adjust the trusses, but this is a very large and expensive job which, in addition, exposes the other parts of the construction to bad weather for a certain time.

In order to enable the triangulation to be withdrawn without removing the roofing, it is known to place support pillars beforehand under the principal rafters. Unfortunately these pillars cannot bear on the tie-beam which is not designed to take up such a load, instead they therefore have to go down as far as the first sufficiently strong slab, for example of concrete, which they meet in the construction and which generally constitutes the floor of the last storey of the building, in the rooms of which storey these pillars cannot always be easily concealed by panels or partitions.

DISCLOSURE OF THE INVENTION

An object of the invention is a process of frame conversion which, without endangering the principal rafters and the cladding, does not require the cladding to be removed or pillars to be provided under the principal rafters, which pillars, for their support, would have to descend to a slab, which in addition is also not designed for such a task.

The invention provides a method of the above-mentioned type, in which before the triangulation elements of each truss are removed:

firstly a vertical channel, consisting of parts rendering the principal rafter and the tie-beam rigid, is fixed between the principal rafter and the tie-beam of at least a plurality of trusses;

at the same time beams, which have previously been divided up into a plurality of sections, are brought into the roof and engaged in the ducts and, on each of the gable walls, there is borne one of the ends of the beam, the sections of which are connected by connection means, below each of which a king post is fixed;

subsequently, the base of each of the king posts is grasped by one of the ends of two ties, the other ends of which are at least indirectly connected to the ends of the beam sections located either side of the king post in question;

finally, by maneuvring suitable means, the ties are caused to act and, owing to the reaction of their king post with which they form a triangulation, support the beam, which itself then supports the principal rafters, the roof, and the tie-beams, at least indirectly;

after checking the raising of the roof, the initial triangulation of the trusses is removed, and then the roof is fitted out.

The invention also provides frame elements for performing this method.

The invention will be well understood by referring to the following description, given by way of non-limiting example, with reference to the accompanying schematic drawings.

BRIEF DESCRIPTION OF THE DRAWINGS

FIG. 1 is a transverse section through a roof which is not able to be fitted out, before conversion;

FIG. 2 is a similar view of the roof, after conversion;

FIG. 3 is a section on line III—III of FIG. 2; and

FIG. 4 shows, on a larger scale, a detail of a converted truss.

BEST MODE FOR CARRYING OUT THE INVENTION

It may be seen that the roof frame 1 comprises a plurality of trusses 2 extending from one facade wall 3 to another 4. The trusses 2 are placed at a slight distance D from one another and bear the roofing (not shown). Each truss 2 comprises a horizontal tie-beam 5, connecting the walls 3,4, and two principal rafters 6,7, which extend as far as the ridge of the roof.

The load P of the roof imparts flexional stress to the principal rafters 6,7, which, like the tie-beams, therefore have to be supported. For this purpose, before conversion, the principal rafters 6,7 and the tie-beam 5 are connected to one another by elements 8,9,10,11 forming a triangulation.

Before the triangulation is removed, there is fixed between the principal rafter 6 and/or 7 and the tie-beam 5 of some or (preferably) all of the trusses 2, a vertical channel 12 formed by the cleft between two struts 13,14 for example of wood, whose ends are secured to the tie-beam and the corresponding principal rafter by any known means such as nailing, screwing, dowelling, riveting, bolting, or even welding in the case of metal trusses.

At the same time, there are brought into the roof and engaged in the channels 12, beams 15 which have previously been divided into a plurality of sections 16,17,18,19 each with reduced dimensions depending upon the possibilities for access. The ends of the beam 15 bears on the respective gable walls 20,21. The sections 16,17,18,19 of the beam are connected together by connection means 22,23,24, below each of which a respective king post 25,26, or 27 is secured.

Subsequently, the base of each of the king posts is grasped by one of the ends of two ties 31,32, the other ends of which are connected directly or indirectly to the ends of the beam sections located either side of the king post in question.

Finally, a reference rope is placed between the gables and marks are plotted on each truss, then the ties are acted upon and, owing to the reaction on their king posts with which they form a triangulation, they support the beam 15, which itself may directly or indirectly support the principal rafters and both the roofing and the future floor.

As soon as the roofing has been lifted at least some millimeters, after the floor has possibly been reinforced, the elements 8,9,10,11 of the initial triangulation, which has become unnecessary, are removed.

The vertical channels 12 are maintained so as to avoid any lateral displacement of the beam 15 and its tensioning system.

These channels 12 and/or the beams 15 may, moreover, be used to support the covering 37 of the vertical walls of the room to be prepared, such as sheets of plaster, plywood, agglomerate, etc. and, if necessary, to support a cross bar 38 which receives reinforcements 39 of a floor 40. This reinforcement may be constructed in the same way as the beam 15. The covering 37 will then conceal all this framework.

The floor reinforcements may be designed in a plurality of sections connected and subtended in a manner similar to the beam 15.

Apart from the conversion method, the invention also relates to the channels 12 and the beams 15 as well as to the elements which form them and thus ensure the performance of the method.

In this respect, the connection means 22,23,24 of the beam sections 16,17,18,19 may consist of articulation shafts, but preferably they consist of forks borne at the top of the king posts 25,26,27, in which the ends of the said sections are simply positioned and brought to bear against one another end to end directly or by means of an intercalated part correcting the length of the beam.

In order to facilitate installation, wedges may ensure a relative connection of the sections.

As regards the ties, the cross-sections of which may be circular or prismatic, they may advantageously be formed by threaded rods cut longitudinally or they may be formed by two parts connected by a tension member 41.

In order to connect them to the adjusting points, the ends of the ties are preferably provided with a detachable means such as a nut engaged on the end of the threaded member 41 after being passed through a sleeve or a lug or a hook engaging in an eyelet of a lug.

Although the invention has been described with reference to a roof with only two slopes, it may evidently apply to roofs having more than two slopes, even if the habitable space recovered is smaller, since at least some of the beam sections may then be inclined or offset so as to transfer the load of the trusses onto the base of the gables.

I claim:

1. A method of converting a roof frame bearing the roofing of a construction having at least two gable walls and two facade walls, the frame being located between two gable walls and comprising a plurality of trusses spaced from one another and extending from one facade wall to another, on which walls the trusses bear, each truss comprising a horizontal tie-beam and two inclined principal rafters which are connected to one another by triangulation elements supporting the principal rafters in order to enable them to resist the bending stress to which they are subjected owing to the load of the roofing, the method comprising the following steps:

(a) fixing a vertical channel between each of the principal rafters and the tie-beam of at least a plurality of the trusses;

(b) bringing into the roof and engaging in the channels, beams which have previously been divided into a plurality of sections, the ends of the beams bearing on the gable walls;

(c) connecting the sections of each beam together by connection means;

(d) securing a king post below each of the said connection means;

(e) engaging the base of each king post with two ties whose other ends are connected at least indirectly to the ends of the beam sections located either side of the king post in question, and (f) stressing the ties so that, owing to their reaction on the king posts with which they form triangulations, they support the beams, which themselves support the principal rafters and the roofing at least indirectly, thereby enabling the initial triangulation of the trusses to be removed and subsequently the roof to be fitted out.

2. Apparatus for use in converting a roof frame by a method as claimed in claim 1, comprising at least one beam consisting of a plurality of sections and connection means connecting the sections of the beam to one another, a plurality of king posts, each connection means being secured at the top of a king post, and a plurality of ties, the base of each king post being connected to two of the ties, whose other ends are secured at least indirectly to the ends of the sections located either side of the king post in question.

3. The apparatus of claim 2, in which the connection means each comprise a fork in which the ends of the corresponding beam sections are positioned and brought to bear at least indirectly against each other end to end.

4. The apparatus of claim 2, further comprising crossbars for supporting a floor by means of reinforcements.

5. The apparatus of claim 4, in which the reinforcements are constructed in the same manner as the said beam.

6. The apparatus of claim 2, further comprising channels, each defined by two vertical uprights secured by their ends between a principal rafter and a tie-beam of a truss.

7. Apparatus for use in converting a roof frame by a method as claimed in claim 1, comprising channels, each defined by two vertical uprights secured by their ends between a principal rafter and a tie-beam of a truss.

8. The apparatus of claim 7, further comprising crossbars for supporting a floor by means of reinforcements.

9. The apparatus of claim 8, in which the reinforcements each comprise a plurality of sections connected end to end.

* * * * *